US008047026B2

(12) United States Patent
Won

(10) Patent No.: US 8,047,026 B2
(45) Date of Patent: Nov. 1, 2011

(54) WASHING MACHINE

(75) Inventor: Yong Kwon Won, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/802,071

(22) Filed: May 18, 2007

(65) Prior Publication Data

US 2008/0011024 A1 Jan. 17, 2008

(30) Foreign Application Priority Data

Jul. 11, 2006 (KR) ..... 10-2006-0065068

(51) Int. Cl.
*D06F 39/14* (2006.01)

(52) U.S. Cl. ..... 68/196

(58) Field of Classification Search ..... 68/12.18, 68/12.26, 96, 142, 196, 212; 134/57 DL, 134/58 DL; 296/100.06, 100.08, 100.09, 296/100.14, 136.08, 136.13
See application file for complete search history.

(56) References Cited

U.S. PATENT DOCUMENTS

| | | | | |
|---|---|---|---|---|
| 5,546,773 | A * | 8/1996 | Lee | 68/196 |
| 6,463,766 | B2 * | 10/2002 | Kubota et al. | 68/12.18 |
| 2005/0072194 | A1 * | 4/2005 | Ryohke et al. | 68/3 R |

FOREIGN PATENT DOCUMENTS

| | | | |
|---|---|---|---|
| CN | 1536133 | A | 10/2004 |
| JP | 11319380 | A * | 11/1999 |
| JP | 2000-279689 | * | 10/2000 |
| JP | 2000350891 | * | 12/2000 |
| JP | 2001-009192 | * | 1/2001 |
| JP | 2004-113276 | * | 4/2004 |
| KR | 10-2004-0073768 | A * | 8/2004 |
| KR | 2004-73768 | | 8/2004 |

OTHER PUBLICATIONS

Machine Translation of KR 10-2004-0073768 A.*
Machine Translation of JP 11-319380 A.*
Machine translation of JP2000350891.*
Chinese Office Action issued on May 8, 2009 in corresponding Chinese Patent Application 2007101088575.
Chinese Office Action mailed Nov. 13, 2009 in corresponding Chinese Patent Application 200710108857.5.

* cited by examiner

*Primary Examiner* — Frankie L Stinson
(74) *Attorney, Agent, or Firm* — Staas & Halsey LLP

(57) ABSTRACT

A washing machine wherein the structure of a door to open and close a laundry inlet hole formed at the upper part of a housing is improved. The door includes front and rear door parts hingedly coupled with each other. The front door part has a front-to-rear length less than that of the rear door part. Consequently, when the door is opened, the front door part is folded to the rear door part and the lower end of the front door part is located at the upper part of the rear door part. The rear door part has a see-through portion, through which the interior of the housing is seen while the door is closed.

11 Claims, 3 Drawing Sheets

WASHING MACHINE

CROSS-REFERENCE TO RELATED APPLICATIONS

This application claims the benefit of Korean Patent Application No. 10-2006-0065068, filed on Jul. 11, 2006 in the Korean Intellectual Property Office, the disclosure of which is incorporated herein by reference.

BACKGROUND OF THE INVENTION

1. Field of the Invention

The present invention relates to a washing machine, and, more particularly, to a washing machine wherein the structure of a door to open and close a laundry inlet hole formed at the upper part of a housing is improved such that the opening and closing of the door are easily accomplished and the door is prevented from interfering with the opening and closing operations of a detergent box disposed at the rear part of the housing.

2. Description of the Related Art

Generally, a washing machine is constructed in a structure in which a water tub and a rotary tub are mounted in a housing forming the appearance of the washing machine, and the rotary tub is connected to a drive motor such that the rotary tub, in which laundry and wash water are contained, is rotated by the drive motor so as to wash the laundry.

The water tub and the rotary tub are formed in the shape of a drum having an open upper part. The housing has a laundry inlet hole formed at the upper part thereof, and the upper part of the housing is open together with the rotary tub such that laundry is put into or removed from the rotary tub through the upper part of the housing. At the laundry inlet hole is mounted a door, which is hingedly coupled to the housing, to open and close the laundry inlet hole.

The door of the washing machine is generally constructed so that two members are hingedly coupled with each other in a folding fashion so as to easily accomplish the opening and closing operations of the door. An example of such a door is disclosed in Korean Patent Application Publication No. 10-2004-0073768.

The conventional washing machine is constructed so that a door to open and close a laundry inlet hole of a housing is divided into a front door part and a rear door part, which are hingedly coupled with each other, and the rear end of the rear door part is hingedly coupled to the rear part of the housing.

Consequently, when the door is pushed rearward while a grip formed at the front door part is held, the front door part and the rear door part are rotated while the front door part and the rear door part are folded to each other. As a result, the laundry inlet hole is opened. When the grip of the front door part is held and pulled forward, on the other hand, the door is closed. As a result, the laundry inlet hole is closed.

In the conventional washing machine with the above-stated construction, however, the front door part and the rear door part have the same size, and the door is folded and unfolded about the middle part thereof. For this reason, the folding and unfolding actions of the front door part to and from the rear door part are large, and therefore, it is inconvenient to open and close the door.

In addition, the front door part of the conventional washing machine is made of a transparent material such that a user can see the interior of the housing. However, hinge members mounted at the middle part of the door interfere with seeing the interior of the housing, which reduces the see-through efficiency.

Furthermore, since the front and rear door parts of the conventional washing machine have the same size, when the door is opened, and therefore, the front door part and the rear door part are folded to each other, the front door part is placed adjacent to a detergent box disposed at the rear part of the housing. Consequently, it is inconvenient to draw out the detergent box and put detergent into the detergent box.

SUMMARY OF THE INVENTION

Therefore, it is an aspect of the invention to provide a washing machine wherein the structure of a door to open and close a laundry inlet hole formed at the upper part of a housing is improved such that the opening and closing of the door are easily accomplished and the door is prevented from interfering with the opening and closing operations of a detergent box disposed at the rear part of the housing.

In accordance with one aspect, the present invention provides a washing machine including a housing having a laundry inlet hole formed at an upper part thereof and a door to open and close the laundry inlet hole, wherein the door includes front and rear door parts hingedly coupled with each other, the front door part having a front-to-rear length less than that of the rear door part.

The ratio of the front-to-rear length of the front door part to the front-to-rear length of the rear door part may be approximately 0.3 or less.

The rear door part may be a see-through portion, through which the interior of the housing is seen while the door is closed.

The front door part may have a grip formed at a surface thereof to enable a user to easily open and close the door.

Preferably, a detergent box is disposed at the rear part of the inside of the housing below the laundry inlet hole such that the detergent box is coupled to and uncoupled from the housing in a sliding fashion.

In accordance with another aspect, the present invention provides a washing machine including a housing having a laundry inlet hole formed at an upper part thereof and a door to open and close the laundry inlet hole, wherein the door includes front and rear door parts hingedly coupled with each other, the front door part having a size less than that of the rear door part.

In accordance with yet another aspect, the present invention provides a washing machine including a housing having a laundry inlet hole formed at an upper part thereof and a door to open and close the laundry inlet hole, wherein the door includes a front door part, a rear door part, and hinge members to hingedly couple the front and rear door parts such that the front door part is rotated with respect to the rear door part, the hinge members being biased to the front part of the housing from the middle of the door.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
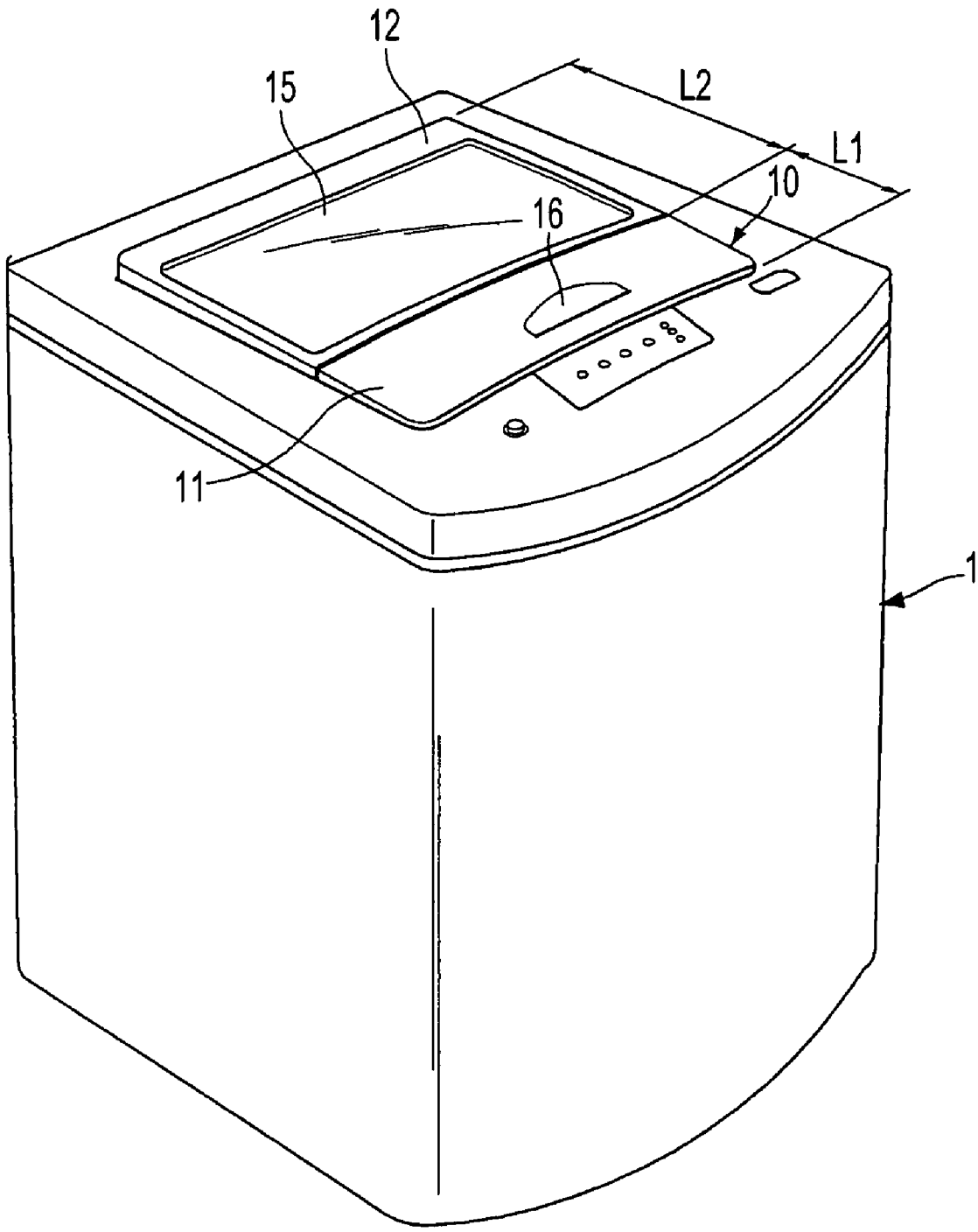
FIG. 1 is a perspective view illustrating a door of a washing machine according to the present invention when closed.

Reference will now be made in detail to the embodiment of the present invention, examples of which are illustrated in the accompanying drawings, wherein like reference numerals refer to like elements throughout. The embodiment is described below to explain the present invention by referring to the figures.

Figure 2:
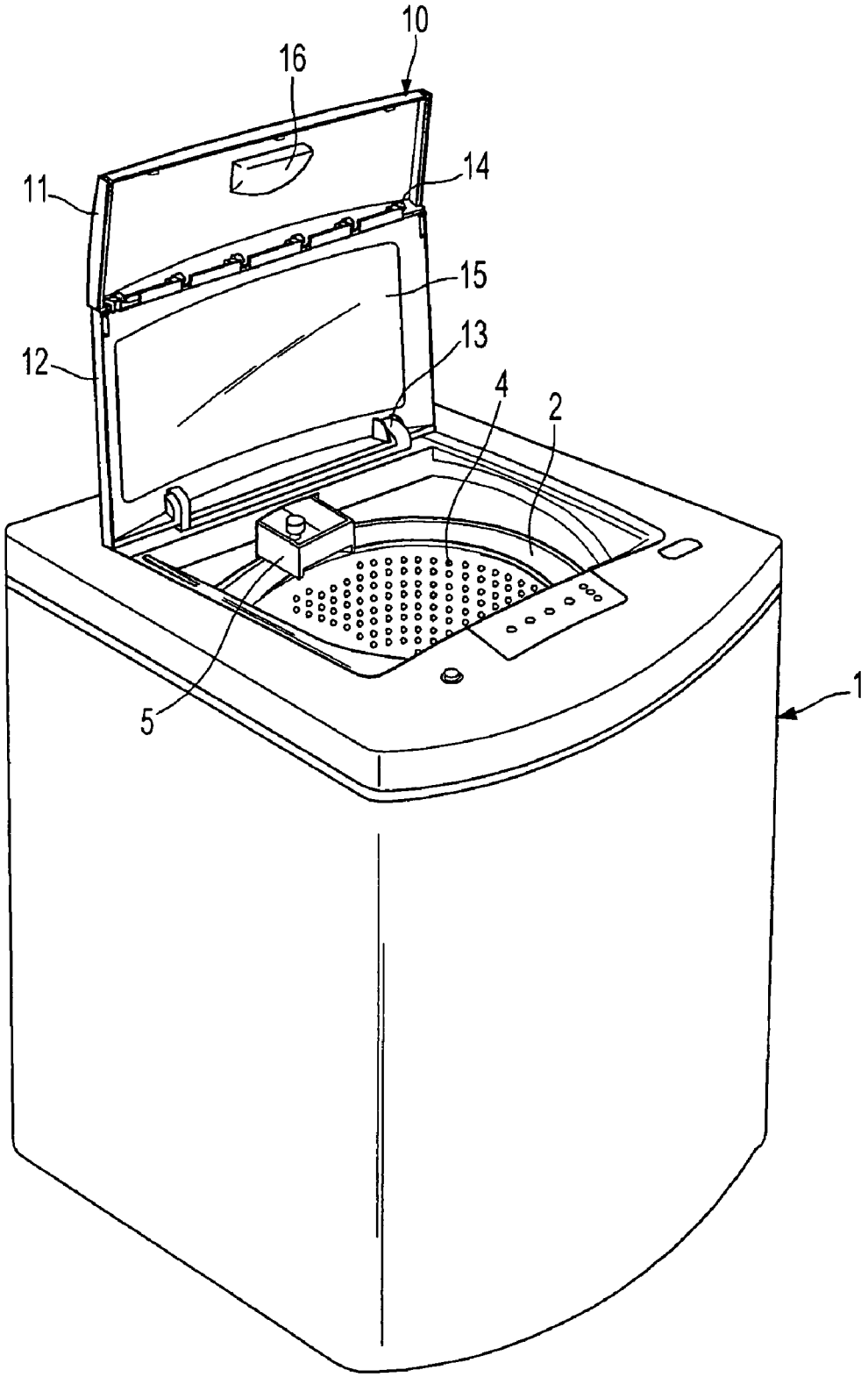
FIG. 2 is a perspective view illustrating the door of the washing machine according to the present invention when opened.

FIG. 1 is a perspective view illustrating that when a door of a washing machine according to the present invention is closed, a laundry inlet hole of a housing is closed. FIG. 2 is a perspective view illustrating that when the door of the washing machine according to the present invention is opened, the laundry inlet hole of the housing is opened.

As shown in FIGS. 1 and 2, the washing machine according to the present invention includes a housing 1 formed in the shape of a box and having a laundry inlet hole 2 formed at the upper part thereof, a drum-shaped water tub 3 (see FIG. 3) mounted in the housing 1 and having an open upper part, through which laundry is put into the water tub 3, a rotary tub 4 rotatably mounted in the water tub 3, a drive motor (not shown) coupled to the lower part of the water tub 3 to rotate the rotary tub 4, a drainage pump and a drainage hose (not shown) to drain wash water from the housing 1, and a door 10 to open and close the laundry inlet hole 2.

At the rear part of the inside of the housing 1, below the laundry inlet hole 2, is disposed a detergent box 5 to allow wash water to be mixed with detergent such that laundry can be cleanly washed in a forward-and-backward sliding fashion.

The door 10 includes a front door part 11 to cover the front part of the laundry inlet hole 2 and a rear door part 12 to cover the rear part of the laundry inlet hole 2.

At the rear end of the rear door part 12 and the rear part of the housing 1 are mounted first hinge members 13, by which the rear door part 12 is hingedly coupled to the housing 1. At the rear end of the front door part 11 and the front end of the rear door part 12 are mounted second hinge members 14, by which front door part 11 is hingedly coupled to the rear door part 12.

The front door part 11 has a front-to-rear length L1 less than a front-to-rear length L2 of the rear door part 12. As a result, the rear door part 12 has a size or area greater than that of the front door part 11.

Consequently, the second hinge members 14 are not located at a position corresponding to the middle of the total length (L1+L2) of the door 10 but biased to the front part of the housing 1.

When the ratio of the front-to-rear length L1 of the front door part 11 to the front-to-rear length L2 of the rear door part 12 is approximately 0.3 or less, an aspect of the present invention is accomplished.

At the rear door part 12 having an area greater than that of the front door part 11 is formed a see-through portion 15, through which the interior of the housing can be seen even while the door 10 is closed, and therefore, the laundry inlet hole 2 of the housing 1 is closed. Consequently, a user can see a process for washing the laundry in the rotary tub 4.

At the surface of the front door part 11 is formed a grip 16 for the user to hold such that the user can easily raise or lower the front door part 11.

Hereinafter, the operation of the washing machine with the above-stated construction will be described with reference to FIG. 3.

Figure 3:
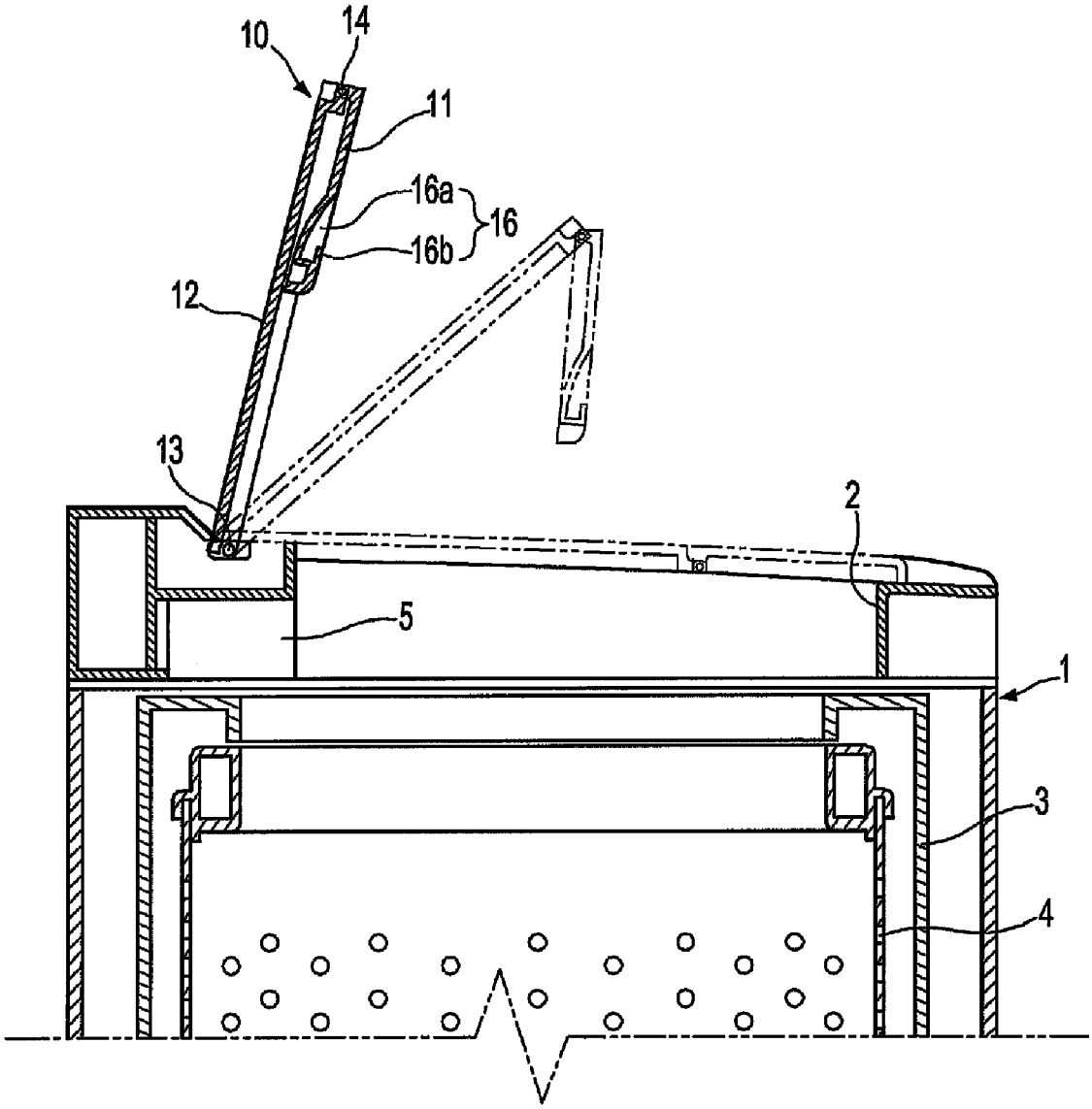
FIG. 3 is a view illustrating the operation of the door of the washing machine according to the present invention.

As shown in FIG. 3, when the user raises the front door part 11 of the door 10 so as to wash laundry while holding the grip 16 formed at the front door part 11, the front door part 11 is rotated by the second hinge members 14 with the result that the front door part 11 is folded to the rear door part 12. At the same time, the rear door part 12 is rotated by the first hinge members 13. The grip 16 in the front door part 11 includes a recessed portion 16*a* and a handle portion 16*b* extending over a front section of the recessed portion 16*a* to accommodate human fingers when the palm of a user's hand is positioned facing the front door part. The grip 16 is provided at a top of the front door part 11 to enable a user to open and close the door with the palm of the hand facing the front door part 11.

When the door 10 is fully opened by the rotation of the first and second door parts, the rear door part 12 is rotated upward at the rear part of the housing 1 while the rear surface of the front door part 11 is in tight contact with the rear surface of the rear door part 12. As a result, the laundry inlet hole 2 is opened.

Since the lower end of the front door part 11 is located at the upper part of the rear door part 12 while the front door part 11 is folded to the rear door part 12, the front door part 11 is spaced apart from the detergent box disposed adjacent to the laundry inlet hole 2 at the rear part of the inside of the housing 1. Consequently, the front door part 11 does not interfere with the opening and closing operations of the detergent box 5.

Subsequently, the user opens the detergent box to put detergent into the detergent box, and puts laundry to be washed into the rotary tub 4 through the laundry inlet hole 2. After that, when the user pulls the front door part 11 downward while holding the grip 16 of the front door part 11, the laundry inlet hole 2 is closed by the door 10.

Subsequently, when wash water having passed through the detergent box 5 and thus mixed with detergent in the detergent box 5 is supplied to the water tub, and the drive motor is operated, the rotary tub 4 is rotated in alternating directions to wash the laundry. At this time, the user can see a process for washing the laundry in the rotary tub 4 through the see-through portion 15 of the rear door part 12 having a size greater than that of the front door part 11.

When the washing of the laundry is completed, the drainage pump is operated to drain the wash water from the housing 1, and the rotary tub 4 is rotated in high speed to spin-dry the laundry. After that, the user opens the door 10 in the same manner as the above-described operation, and removes the laundry having been cleanly washed through the laundry inlet hole 2.

As apparent from the above description, the washing machine according to the present invention is constructed so that the door includes the front door part and the rear door part, which are hingedly coupled with each other, and the front-to-rear length of the front door part is less than that of the rear door part. Consequently, the folding and unfolding actions of the front door part to and from the rear door part are small, and therefore, it is easy and convenient to open and close the door.

In addition, the washing machine according to the present invention is constructed in a structure in which the see-through portion is formed at the rear door part having a size greater than that of the front door part. Consequently, it is possible for a user to easily see a process for washing laundry in the housing.

Furthermore, the washing machine according to the present invention is constructed so that when the door is opened, the front door part is folded to the rear door part, and the lower end of the front door part is located at the upper part of the rear door part. Consequently, the front door part does not interfere with the opening and closing operation of the detergent box disposed adjacent to the laundry inlet hole at the rear part of the housing Therefore, it is easy and convenient to put detergent into the detergent box.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A washing machine comprising:

a housing having a laundry inlet hole formed at an upper part thereof;

a rotating tub rotatably mounted in the interior of the housing, to receive laundry in the interior of the rotating tub, the rotating tub having an opening corresponding to the laundry inlet hole; and a door to open and close the laundry inlet hole, wherein the door includes front and rear door parts hingedly coupled with each other, the front door part and the rear door part each having front-to-rear lengths, L1 and L2, respectively, satisfying a relation of L1/L2<0.3, only the rear door part of the front and rear door parts has a see-through portion covering at least ½ of an entire area of the laundry inlet hole, to make the interior of the rotating tub visible through the see-through portion of the rear door part in a closed state of the door, the front door part has a grip including a recessed portion and a handle portion extending over a front section of the recessed portion to accommodate human fingers when the palm of a user's hand is positioned facing the front door part, wherein the grip is provided at a top of the front door part to enable a user to open and close the door with the palm of the hand facing the front door part, the door is configured such that the interior of the rotating tub is visible through the rear door part but not visible through the front door part, the door is adapted to be opened by lifting the handle portion of the grip with fingers placed in the recessed portion and the palm of the hand facing the front door part such that a front edge of the front door part is initially raised above and separated from the housing by rotation movement of the door with respect to a first hinge located at a rear end of the rear door part and then the front door part is subsequently caused to be rotated with respect to a second hinge pivotally joining a rear end of the front door part and a front end of the rear door part until the front door part is folded to the rear door part while the rear door part is further rotated with respect to the first hinge to an opened position, and the front-to-rear length L1 of the front door part is more than three times smaller than the front-to-rear length L2 of the rear door part so as to make the door unsuitable for sliding of the front edge of the front door part against a top surface of the housing during opening of the door.

2. The washing machine according to claim 1, further comprising:

a detergent box disposed at the rear part of the inside of the housing below the laundry inlet hole such that the detergent box is coupled to and uncoupled from the housing in a sliding fashion.

3. The washing machine according to claim 1, wherein the see-through portion has a lateral width corresponding to a lateral width of the laundry inlet hole.

4. The washing machine according to claim 1, wherein the see-through portion has a side-to-side length greater than a radius of the rotating tub.

5. A washing machine comprising:

a housing having a laundry inlet hole formed at an upper part thereof; and a door to open and close the laundry inlet hole, wherein the door includes front and rear door parts hingedly coupled with each other, the front door part and the rear door part each having front-to-rear lengths, L1 and L2, respectively, satisfying a relation of L1/L2<0.3, only the rear door part of the front and rear door parts has a see-through portion having a lateral width corresponding to a lateral width of the laundry inlet hole, to make the interior of the housing visible through the see-through portion in a closed state of the door, the door is configured such that the interior of the rotating tub is visible through the rear door part but not visible through the front door part, the front door part has a grip including a recessed portion and a handle portion extending over a front section of the recessed portion to accommodate human fingers when the palm of a user's hand is positioned facing the front door part, wherein the grip is provided at a top of the front door part to enable a user to open and close the door with the palm of the hand facing the front door part, the door is adapted to be opened by lifting the handle portion of the grip with fingers placed in the recessed portion and the palm of the hand facing the front door part such that a front edge of the front door part is initially raised above and separated from the housing by rotation movement of the door with respect to a first hinge located at a rear end of the rear door part and then the front door part is subsequently caused to be rotated with respect to a second hinge pivotally joining a rear end of the front door part and a front end of the rear door part until the front door part is folded to the rear door part while the rear door part is further rotated with respect to the first hinge to an opened position, and the front-to-rear length L1 of the front door part is more than three times smaller than the front-to-rear length L2 of the rear door part so as to make the door unsuitable for sliding of the front edge of the front door part against a top surface of the housing during opening of the door.

6. The washing machine according to claim 5, wherein the front door part has a grip formed at a surface thereof to enable a user to easily open and close the door.

7. The washing machine according to claim 5, further comprising:

a detergent box disposed at the rear part of the inside of the housing below the laundry inlet hole such that the detergent box is coupled to and uncoupled from the housing in a sliding fashion.

8. The washing machine according to claim 5, wherein the see-through portion has a front-to-rear length greater than ½ of a front-to-rear length of the laundry inlet hole.

9. A washing machine comprising:

a housing having a laundry inlet hole formed at an upper part thereof; and a door to open and close the laundry inlet hole, wherein the door includes a front door part, a rear door part, and hinge members to hingedly couple the front and rear door parts such that the front door part is rotated with respect to the rear door part, the hinge members being biased to the front part of the housing from the middle of the door, the front door part and the rear door part each having front-to-rear lengths, L1 and L2, respectively, satisfying a relation of L1/L2<0.3, only the rear door part of the front and rear door parts has a see-through portion to make the interior of the housing visible through the see-through portion in a closed state of the door, the front door part has a grip including a recessed portion and a handle portion extending over a front section of the recessed portion to accommodate human fingers when the palm of a user's hand is positioned facing the front door part, wherein the grip is provided at a top of the front door part to enable a user to open and close the door with the palm of the hand facing the front door part, the door is adapted to be opened by lifting the handle portion of the grip with fingers placed in the recessed portion and the palm of the hand facing the front door part such that a front edge of the front door part is initially raised above and separated from the housing by rotation movement of the door with respect to a first hinge located at a rear end of the rear door part and then the front door part is subsequently caused to be rotated with respect to a second hinge pivotally joining a rear end of the front door part and a front end of the rear door part until the front door part is folded to the rear door part while the rear door part is further rotated with respect to the first hinge to an opened position, and the front-to-rear length L1 of the front door part is more than three times smaller than the front-to-rear length L2 of the rear door part so as to make the door unsuitable for sliding of the front edge of the front door part against a top surface of the housing during opening of the door.

10. The washing machine according to claim 9, further comprising:

a detergent box disposed at a rear part of the inside of the housing below the laundry inlet hole such that the detergent box is coupled to and uncoupled from the housing in a sliding fashion.

11. A washing machine comprising:

a housing having a laundry inlet hole formed at an upper part thereof;

a detergent box disposed at a rear part of the inside of the housing adjacent to the laundry inlet hole such that the detergent box is slidably moveable forward and backward; and a door to open and close the laundry inlet hole, wherein the door includes a front door part and a rear door part hingedly coupled with each other, the front door part and the rear door part having front-to-rear lengths, L1 and L2, respectively satisfying a relation of L1/L2<0.3, only the rear door part of the front and rear door parts has a see-through portion forming substantially the entire portion of the rear door part, to make the interior of the housing visible through the see-through portion in a closed state of the door, when the door is opened and the front door part is in a folded position, a distance L2-L1 from an upper surface of the detergent box to a lower surface of the folded front door part is greater than the front-to-rear length L1 of the folded front door part, the distance L2-L1 from the upper surface of the detergent box to the lower surface of the folded front door part is at least twice the front-to-rear length L1 of the front door part, such that the lower surface of the folded front door part does not interfere with a hand of a user when the detergent box is opened or closed by the user, the front door part has a grip including a recessed portion and a handle portion extending over a front section of the recessed portion to accommodate human fingers when the palm of a user's hand is positioned facing the front door part, wherein the grip is provided at a top of the front door part to enable a user to open and close the door with the palm of the hand facing the front door part, the door is adapted to be opened by lifting the handle portion of the grip with fingers placed in the recessed portion and the palm of the hand facing the front door part such that a front edge of the front door part is initially raised above and separated from the housing by rotation movement of the door with respect to a first hinge located at a rear end of the rear door part and then the front door part is subsequently caused to be rotated with respect to a second hinge pivotally joining a rear end of the front door part and a front end of the rear door part until the front door part is folded to the rear door part while the rear door part is further rotated with respect to the first hinge to an opened position, and the front-to-rear length L1 of the front door part is more than three times smaller than the front-to-rear length L2 of the rear door part so as to make the door unsuitable for sliding of the front edge of the front door part against a top surface of the housing during opening of the door.

* * * * *